US009351893B2

(12) United States Patent
Jei

(10) Patent No.: US 9,351,893 B2
(45) Date of Patent: May 31, 2016

(54) PATIENT TRANSFER APPARATUS USING SIDE PROTECTOR

(71) Applicant: YangGyu Jei, Pohang-si (KR)

(72) Inventor: YangGyu Jei, Pohang-si (KR)

( * ) Notice: Subject to any disclaimer, the term of this patent is extended or adjusted under 35 U.S.C. 154(b) by 0 days.

(21) Appl. No.: 14/400,393

(22) PCT Filed: May 11, 2013

(86) PCT No.: PCT/KR2013/004196
§ 371 (c)(1),
(2) Date: Nov. 11, 2014

(87) PCT Pub. No.: WO2013/172608
PCT Pub. Date: Nov. 21, 2013

(65) Prior Publication Data

US 2015/0135433 A1 May 21, 2015

(30) Foreign Application Priority Data

May 12, 2012 (KR) ..... 10-2012-0050558

(51) Int. Cl.
*A61G 7/10* (2006.01)
*A61G 7/14* (2006.01)
(Continued)

(52) U.S. Cl.
CPC *A61G 7/103* (2013.01); *A61G 1/02* (2013.01); *A61G 7/1036* (2013.01);
(Continued)

(58) Field of Classification Search
CPC ..... A61G 7/10; A61G 7/1025; A61G 7/103; A61G 7/1034; A61G 7/1036; A61G 7/1046; A61G 7/008; A61G 13/04; A61G 13/08; A61G 13/02; A61G 7/05; A61G 7/0507; A61G 2007/0509; A61G 2007/051; A61G 2007/0513; A61G 2007/0514; A61G 2007/0515; A61G 2007/0516; A61G 2007/0518; A61G 2007/0519; A61G 2007/052; A61G 2007/0522; A61G 2007/0524; A61G 7/0525; A61G 7/053; A47C 21/08; A47C 21/00
USPC ..... 5/81.1 HS, 81.1 R, 83.1, 86.1, 607, 613, 5/617, 424–430, 663, 658, 507.1, 503.1
See application file for complete search history.

(56) References Cited

U.S. PATENT DOCUMENTS 793,168 A * 6/1905 Abrams ..... 5/411
2,113,286 A * 4/1938 White ..... 5/607
(Continued)

FOREIGN PATENT DOCUMENTS

JP 2003-102792 A 4/2003
KR 10-2010-0134949 A 12/2010
KR 10-1027075 B1 4/2011

OTHER PUBLICATIONS

International Searching Authority International Search Report for PCT/KR2013/004196 dated Sep. 26, 2013.

*Primary Examiner* — Robert G Santos
(74) *Attorney, Agent, or Firm* — Sughrue Mion, PLLC

(57) ABSTRACT

A patient transfer apparatus includes a transfer arm for moving a top movable board on which the body of the patient is supported; a transfer arm housing fixed on a patient-moving bed frame so as to move the transfer arm; and a side protector laid on a patient bed so as to serve as a guide rail for enabling the transfer arm to easily move over the patient bed. The patient transfer apparatus enables the patient to simply lie on his/her side from a recumbent position such that the patient can be loaded or unloaded onto/from the patient-moving bed, thus minimizing inconveniences to the patient and easily moving the patient with fewer staff members.

4 Claims, 13 Drawing Sheets

(51) Int. Cl.
*A61G 1/02* (2006.01)
*A61G 7/05* (2006.01)

(52) U.S. Cl.
CPC ..... *A61G 7/1046* (2013.01); *A61G 7/1057* (2013.01); *A61G 7/1088* (2013.01); *A61G 7/1034* (2013.01); *A61G 2007/051* (2013.01); *A61G 2007/0515* (2013.01)

(56) References Cited

U.S. PATENT DOCUMENTS 2,542,963 A * 2/1951 Knox et al. ..... 5/86.1
3,293,668 A * 12/1966 Auer ..... A61G 7/103 5/425
3,344,445 A * 10/1967 Crawford ..... A61G 7/0507 5/430
3,792,500 A * 2/1974 Swara, Sr. ..... 5/81.1 R
4,274,168 A * 6/1981 Depowski ..... 5/81.1 HS
4,839,933 A * 6/1989 Plewright ..... A61G 7/1019 5/428
4,873,732 A * 10/1989 Perez ..... 5/81.1 HS
5,522,100 A * 6/1996 Schilling ..... A61G 7/0507 5/185
5,584,082 A * 12/1996 Crawford ..... A61G 7/015 297/344.17
6,131,215 A * 10/2000 Lindell ..... 5/86.1
6,212,712 B1 * 4/2001 Topp ..... 5/610
6,484,332 B2 * 11/2002 Korver et al. ..... 5/81.1 R
8,171,580 B2 * 5/2012 Wilson et al. ..... 5/81.1 HS
2002/0095722 A1 * 7/2002 Korver et al. ..... 5/81.1 R
2005/0204472 A1 9/2005 Gagneur et al.
2007/0079438 A1 4/2007 Patterson
2009/0307839 A1 * 12/2009 Wilson et al. ..... 5/81.1 HS
2012/0066831 A1 3/2012 Jei
2015/0061679 A1 * 3/2015 Candidus ..... A61B 5/0555 324/321
2015/0135433 A1 * 5/2015 Jei ..... A61G 1/02 5/81.1 HS

* cited by examiner

PATIENT TRANSFER APPARATUS USING SIDE PROTECTOR

CROSS REFERENCE TO RELATED APPLICATIONS

This application is a National Stage of International Application No. PCT/KR2013/004196 filed May 11, 2013, claiming priority based on Korean Patent Application No. 10-2012-0050558 filed May 12, 2012, the contents of all of which are incorporated herein by reference in their entirety.

TECHNICAL FIELD

An apparatus is required which can easily move a patient having problems with mobility while causing minimum inconvenience to the patient when the patient is transferred between a patient bed and a patient-moving bed. The present invention relates to an apparatus associated with a transfer of the patient occurring between the patient bed and the patient-moving bed or between the patient-moving bed (patient stretcher trolley) and various inspection devices when the patient is moved in a hospital.

BACKGROUND ART

Many patent applications are filed domestically and abroad which relate to a patient transfer apparatus for transferring a patient between a patient-moving bed and a patient bed. Many filed and registered domestic and foreign patents use very complex devices or power-transmitting devices and thus a using procedure is complex and expensive facilities are required, so that the patents are not easy to practically apply. U.S. Pat. No. 4,259,756 and KR 10-2002-0049632 etc. are relatively simple in structure and convenient in installation and operation, but suffer from a disadvantage that when the patient lies on a top movable board of the patient transfer apparatus, a great frictional force occurs between the top movable board and a mattress of the patient bed due to the weight of the patient and thus the top movable board is difficult to easily move. To overcome such a disadvantage, U.S. Pat. No. 7,000,268 newly installs transfer arms which allow the top movable board to easily move over the patient bed. However, a complex step is required of separately installing and withdrawing the transfer arms. KR 10-2003-0037260 shows a structure where a belt-type top movable board is moved over the patient bed and the patient's body on the top movable board is also moved together according to movement of the belt. At this time, a distance over which the top movable board is moved over the patient bed has to be longer than a distance over which the patient's body on the top movable board is moved; rather, the distance over which the patient's body on the top movable board is moved is two times the distance over which the top movable board is moved over the patient bed; therefore, practical application is difficult.

According to KR 10-2009-0053325 devised by the applicant, the top movable board can be easily moved over a little longer distance over the patient bed through the transfer arms and a wheeled chassis movable on the transfer arms. In the present invention, instead of the wheeled chassis movable on the transfer arms, a side protector of the patient transfer apparatus is laid on a mattress of the patient bed and the transfer arms are moved over the side protector, whereby the top movable board loaded with the patient's body can be easily moved over the patient bed.

SUMMARY OF THE INVENTION

Technical Problems

The patient transfer apparatus has to safely and easily transfer a patient with fewer persons and without using of external power while causing minimum inconvenience to the patient. Furthermore, the patient transfer apparatus has to be easy to install and operate.

Solution to the Problem

For transferring a lying patient's body from the patient bed (70) onto the patient-moving bed or from the patient-moving bed onto the patient bed (70) without a complex step of installing and withdrawing separate additional devices, the present invention includes: a top movable board (10) on which a patient's body can be loaded in order to load or unload the patient's body onto or from a patient-moving bed; transfer arms (30) which are connected to the top movable board (10) and allow the top movable board (10) to be easily moved; transfer arm housings (34) which are fixed to a frame (60) of a patient-moving bed and are configured such that the transfer arms can be move; and side protectors (50) which can be laid on a patient bed to thus serve as a guide rail that allows the transfer arms to be easily moved over the patient bed. Furthermore, linkages (42, 43) are installed on the top movable board so that the patient's body can be easily loaded or unloaded by inclining the top movable board sidewards.

Effects of the Invention

There are many cases where the patient has to be transferred from the patient bed (70) onto the patient-moving bed for moving the patient from a sickroom to examination and inspection rooms. Furthermore, there are also many cases where the patient has to be transferred from the patient-moving bed onto various inspection apparatuses such as x-ray machine, MRI scanner etc. On all such occasions, it is not easy to move the patient having problems with mobility. On all occasions of moving the patient, a lot of pains are caused to the patient and several persons have to be mobilized. Particularly, as obesity of people recently becomes severe, very great inconvenience occurs in moving the patient having a great weight.

The present invention has advantages that the patient transfer apparatus thereof enables the patient to simply lie on his/her side from a recumbent position such that the patient can be loaded or unloaded onto or from the patient-moving bed, thus minimizing inconveniences accompanying the transfer to the patient and easily moving the patient with fewer persons.

In particular, the patient transfer apparatus of the present invention does not require separate external power for the transfer of the patient and does not require a step of installing or withdrawing separate auxiliary devices and thus is very convenient to operate, and is simple and thus may be supplied in an inexpensive manner.

BEST MODES FOR CARRYING OUT THE INVENTION

Figure 1:
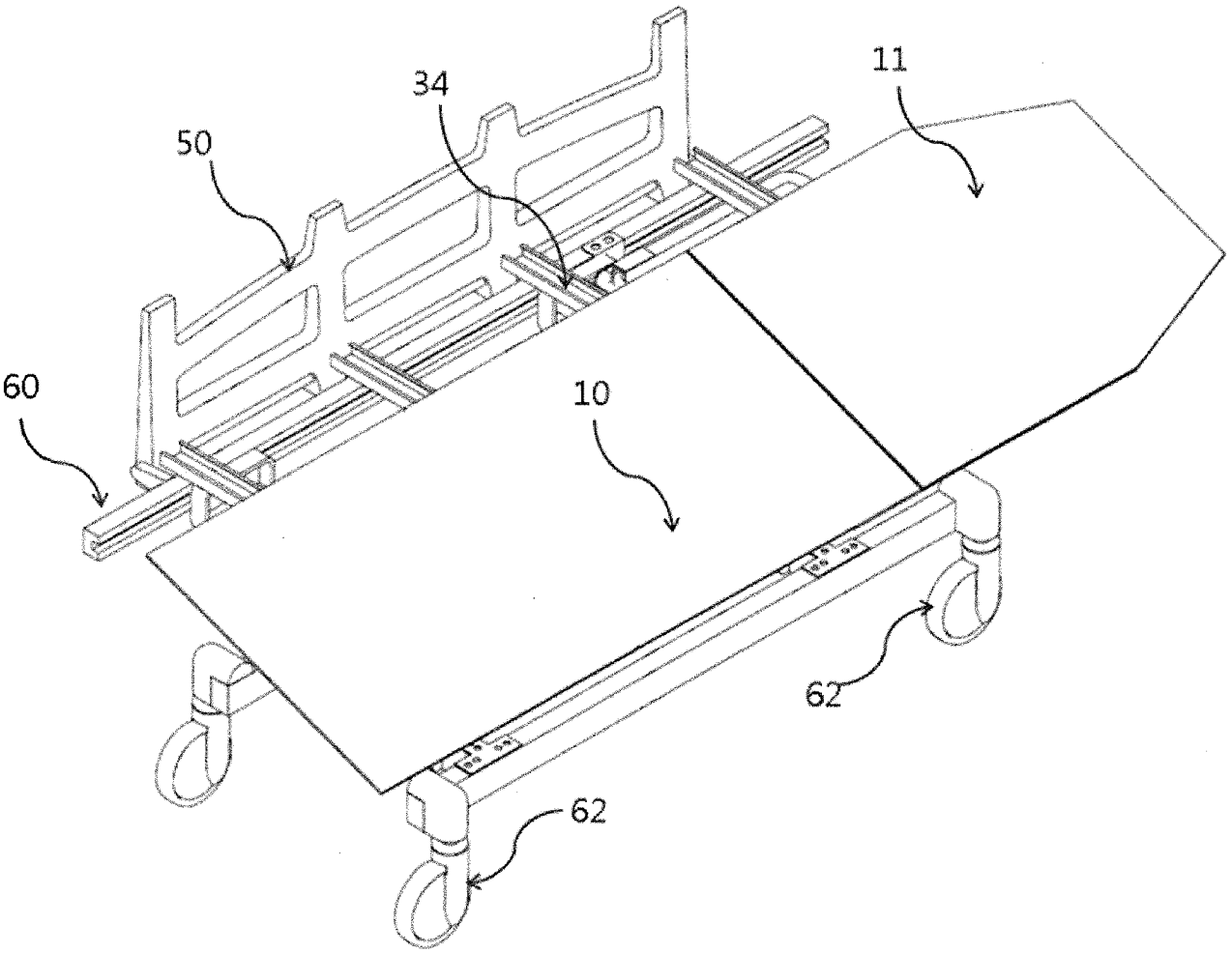
FIG. 1 is a schematic view of a patient-moving bed with a patient transfer apparatus installed thereon.
Figure 2:
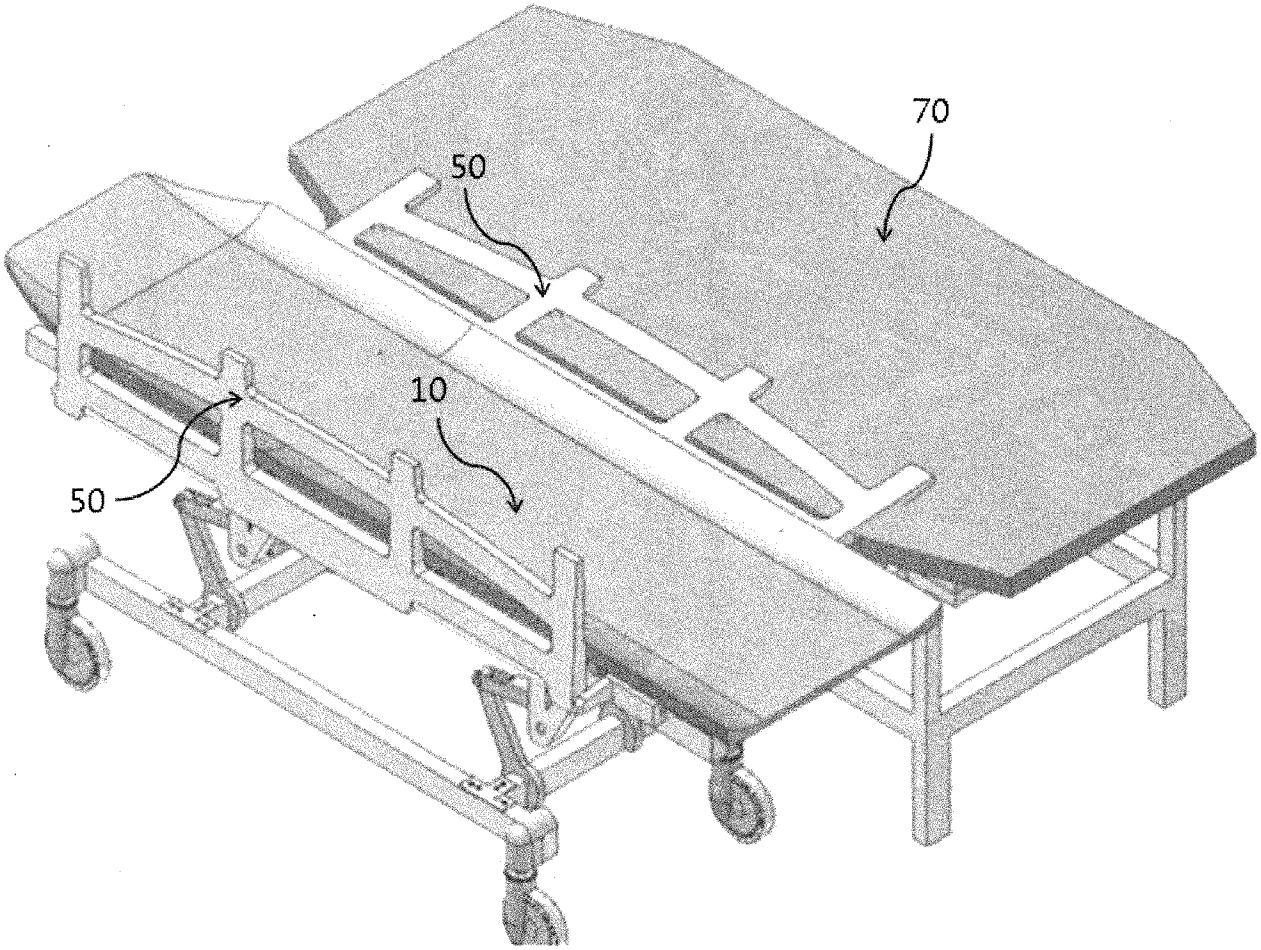
FIG. 2 is a schematic view of the patient-moving bed connected with a patient bed.
Figure 3:
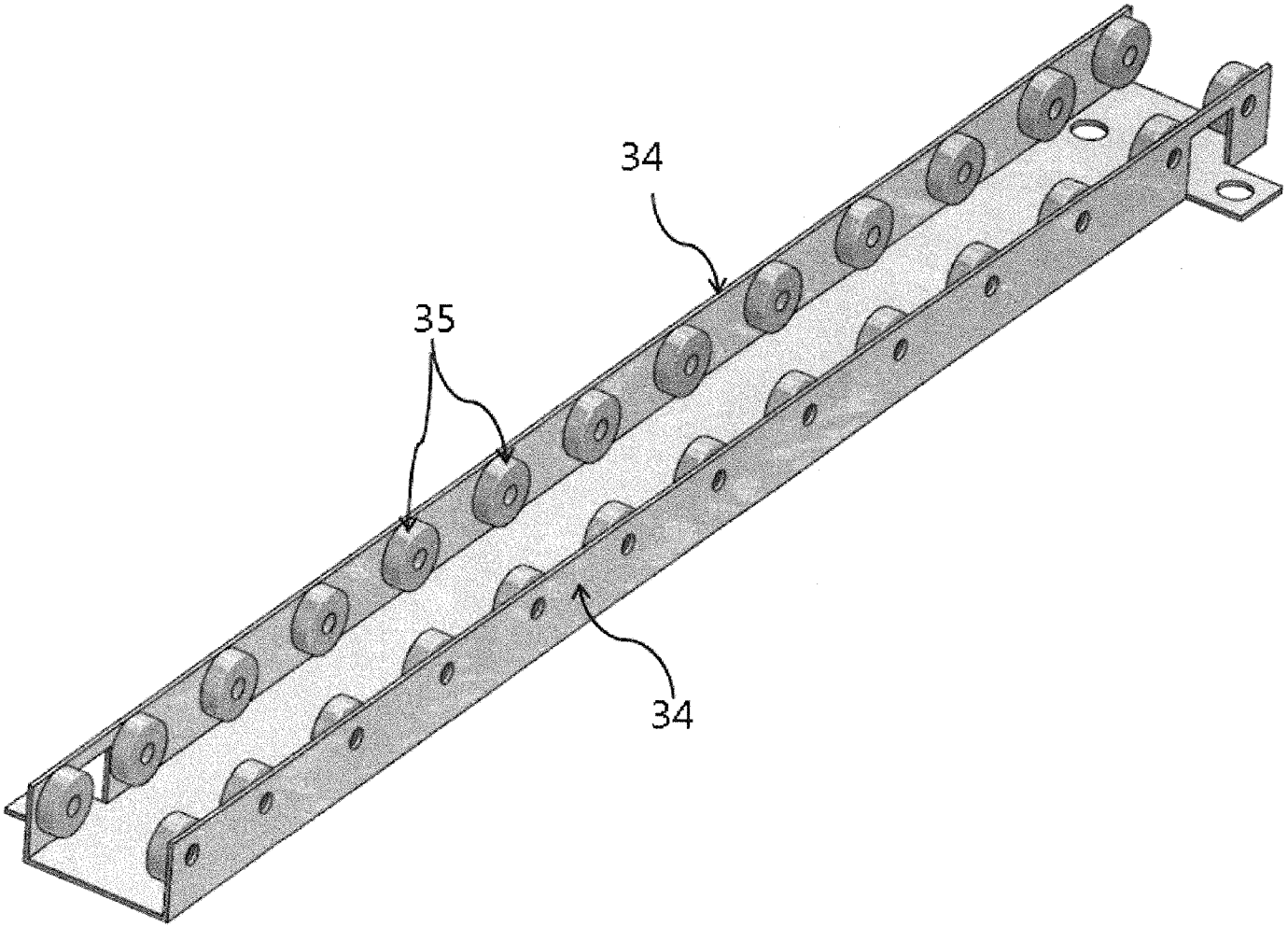
FIG. 3 is a configuration view of a transfer arm housing.
Figure 4:
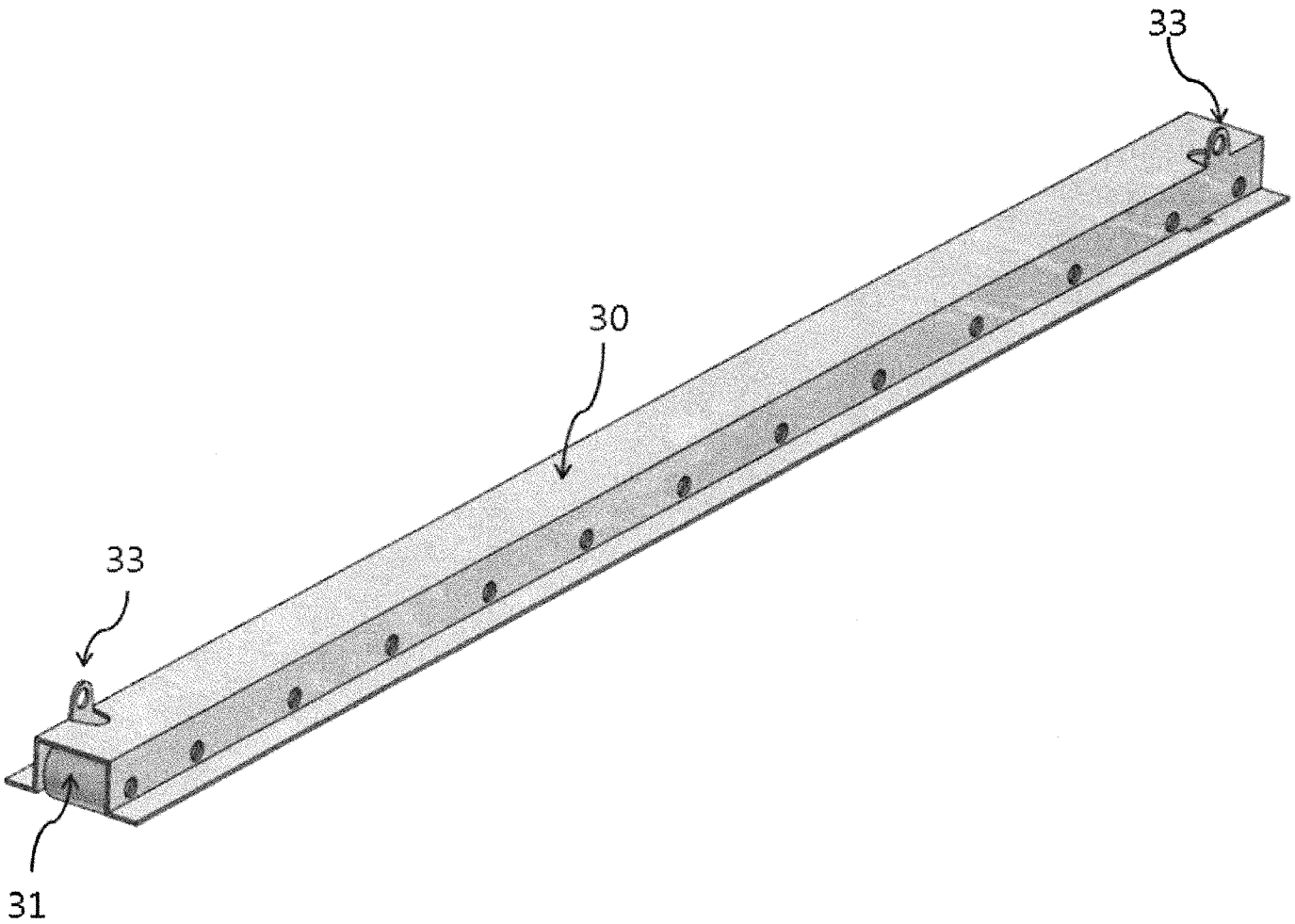
FIG. 4 is a configuration view of a transfer arm.
Figure 5:
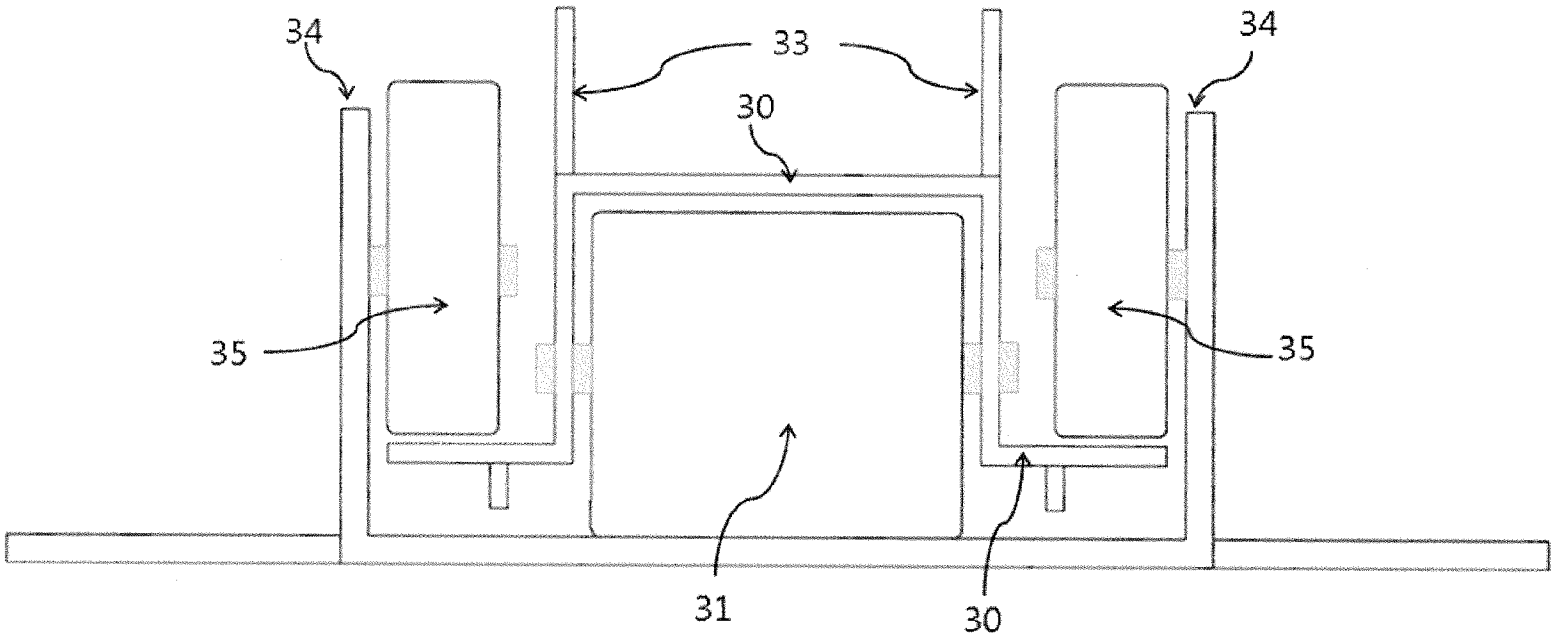
FIG. 5 is a assembled view of the transfer arm and the transfer arm housing.

As shown in FIGS. 1 to 6, transfer arms (30) each equipped with transfer arm rollers (31) and transfer arm housings (34) are installed under a top movable board (10) of a patient-moving bed so that the top movable board can be easily moved over a patient bed. The transfer arm housings (34) are fixed to a frame (60) of the patient-moving bed. When the top movable board (10) of the patient-moving bed is moved over a mattress of the patient bed in order to load or unload the patient onto or from the top movable board (10), particularly in a case where the patient's body is loaded on the top movable board (10), it is not easy to move the top movable board over the patient mattress even though the rollers are equipped under the transfer arms (30). The applicant has been devised a wheeled chassis movable on the transfer arms (30) in order to overcome such a problem, as described in KR 10-2009-0053325.

A good method for easily moving the top movable board (10) over the patient bed is a method allowing the transfer arms (30) itself to easily move over the patient bed, rather than an indirect method of using the wheeled chassis etc. In the present invention, side protectors (50) provided on the patient-moving bed is laid on the mattress of the patient bed (70), and the transfer arms (30) installed on the top movable board (10) are moved over the side protectors (50) instead of the mattress of the patient bed when moved over the patient bed, whereby the top movable board (10) loaded with the patient's body can be easily moved over the patient bed. The side protectors (50) serve as a guide rail allowing the transfer arms (30) to be easily moved over the mattress of the patient bed and also as a safety device preventing the patient-moving bed from falling down due to shift of a center of gravity when the top movable board is moved over the patient bed.

A significant feature of the present invention lies in that a step is not required of separately installing or withdrawing the transfer arms (30) in order to load or unload the patient's body and, when the top movable board (10) is moved, the transfer arms (30) fixed to the top movable board is very easily moved by means of the transfer arm rollers (31) using, as a guide rail, the transfer arm housings (34) and the side protectors (50) installed on the patient bed. In U.S. Pat. No. 7,000,268, a complex step is required of separately installing or withdrawing the transfer arms; however, in the present invention, when the top movable board (10) is moved, the transfer arms (30) are moved together with the board, so that a step is not separately required of installing or withdrawing the transfer arms (30).

Figure 6:
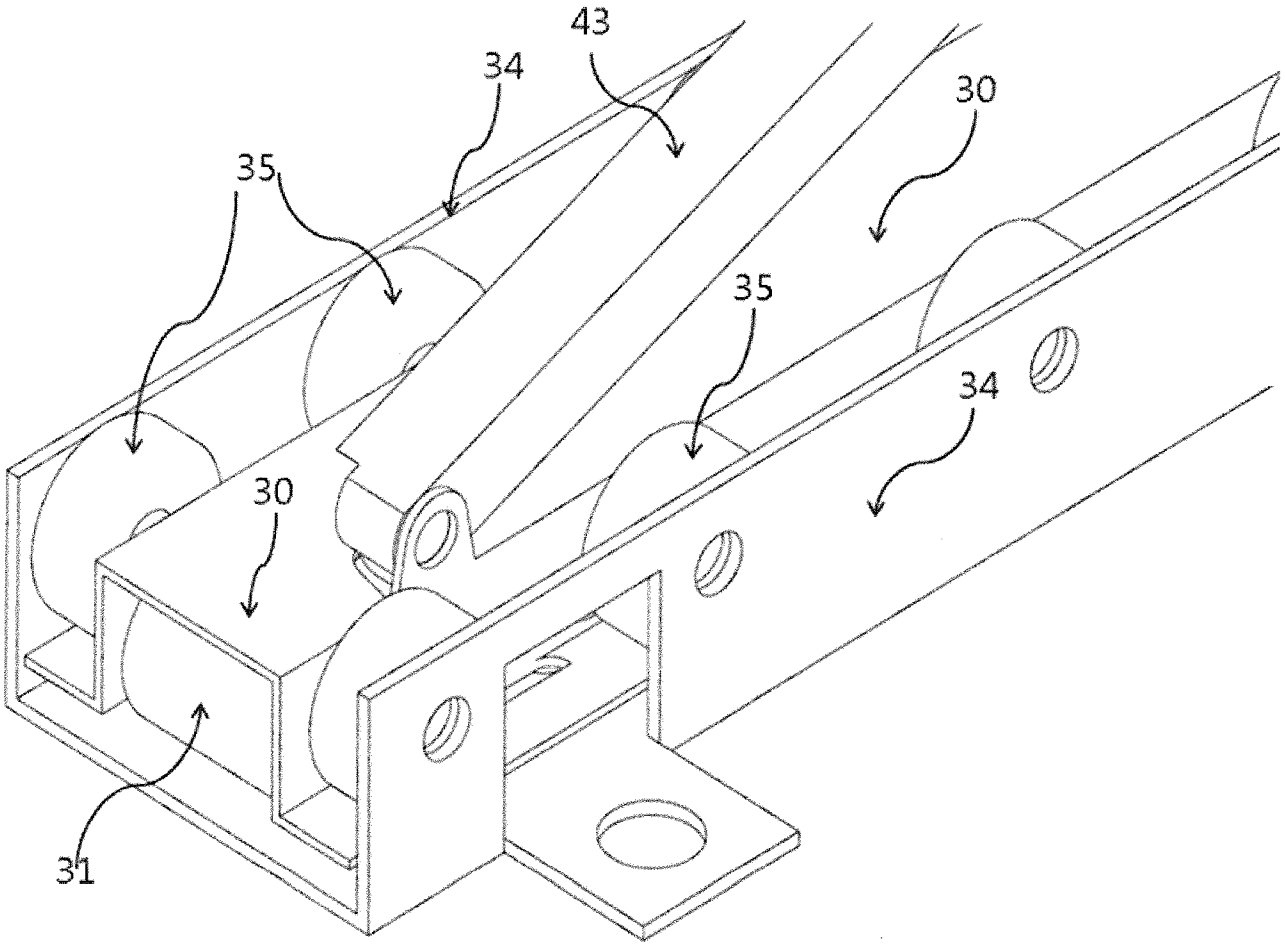
FIG. 6 is an assembled view of the transfer arm and linkages.
Figure 7:
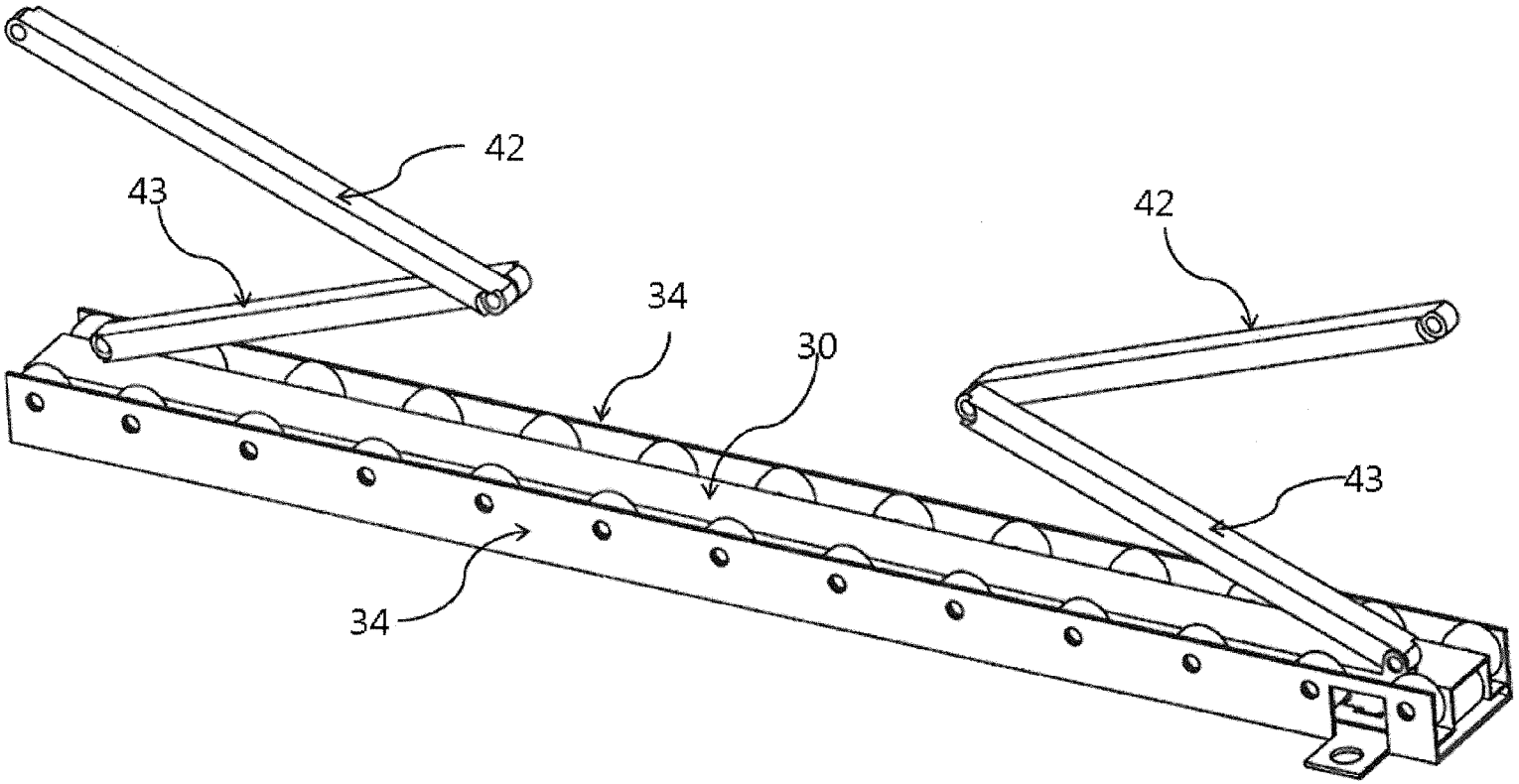
FIG. 7 is an operational view of the linkages.

As shown in FIGS. 6 and 7, linkages (42, 43) are connected between the top movable board (10) and each transfer arm (30) and serve as a pivot when the top movable board (10) is inclined. The linkages allow the top movable board (10) to be inclined toward the patient so that the patient's body can be easily loaded or unloaded. When the top movable board (10) is moved toward the patient in order to load the patient on the patient-moving bed, the patient erects his/her back while lying down. At this time, if the top movable board (10) is also erected so as to face the patient's back, the patient leans the back against the top movable board, and if the top movable board is laid down, the patient's body is naturally laid on the top movable board. Furthermore, when the patient's body is to be unloaded from the patient-moving bed, the top movable board (10) is moved toward the patient bed (70) and then inclined, whereby the patient's body can naturally slide.

Figure 8:
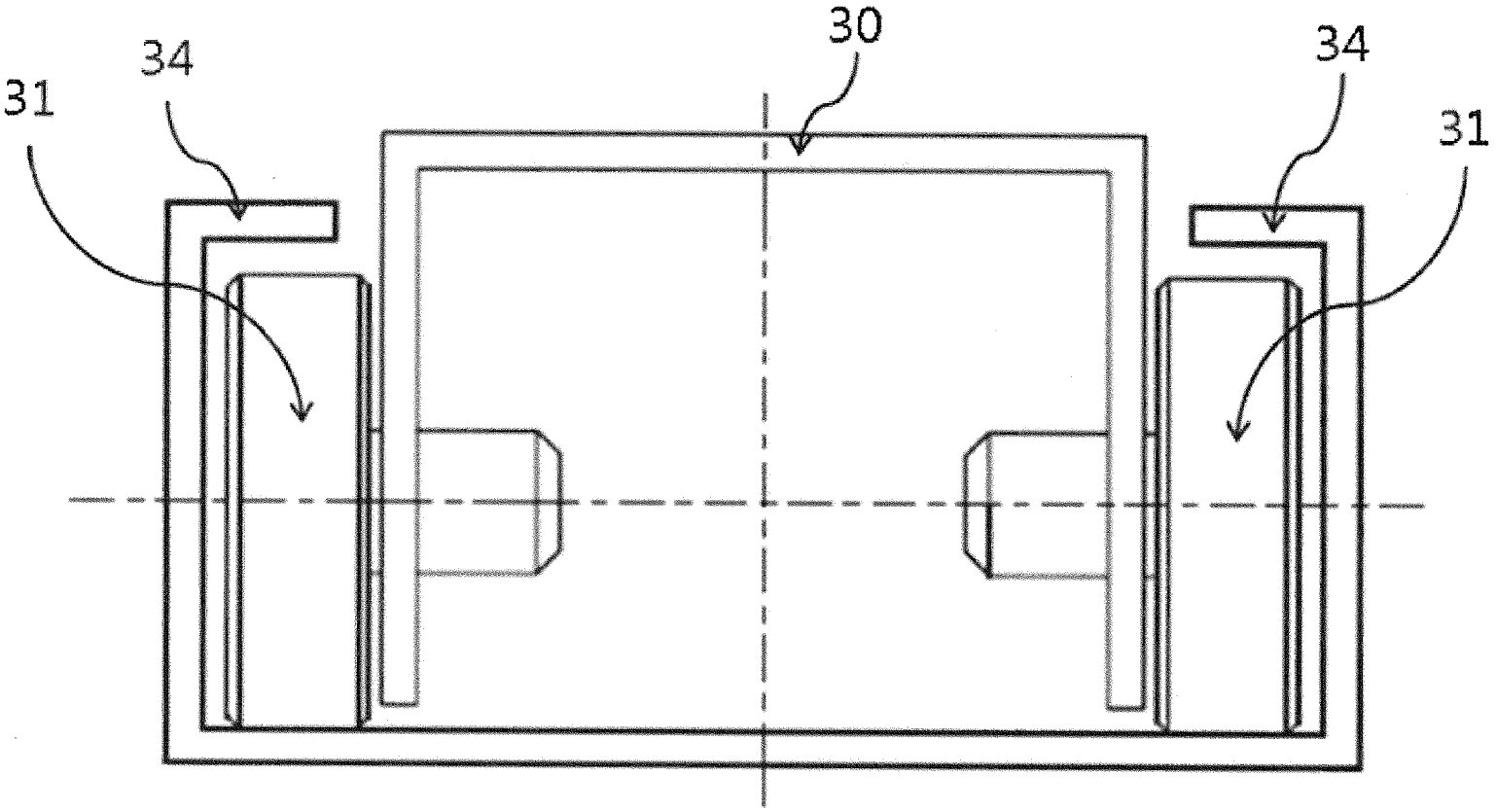
FIG. 8 is a configuration view of the transfer arm and the transfer arm housing without the linkages.
Figure 9:
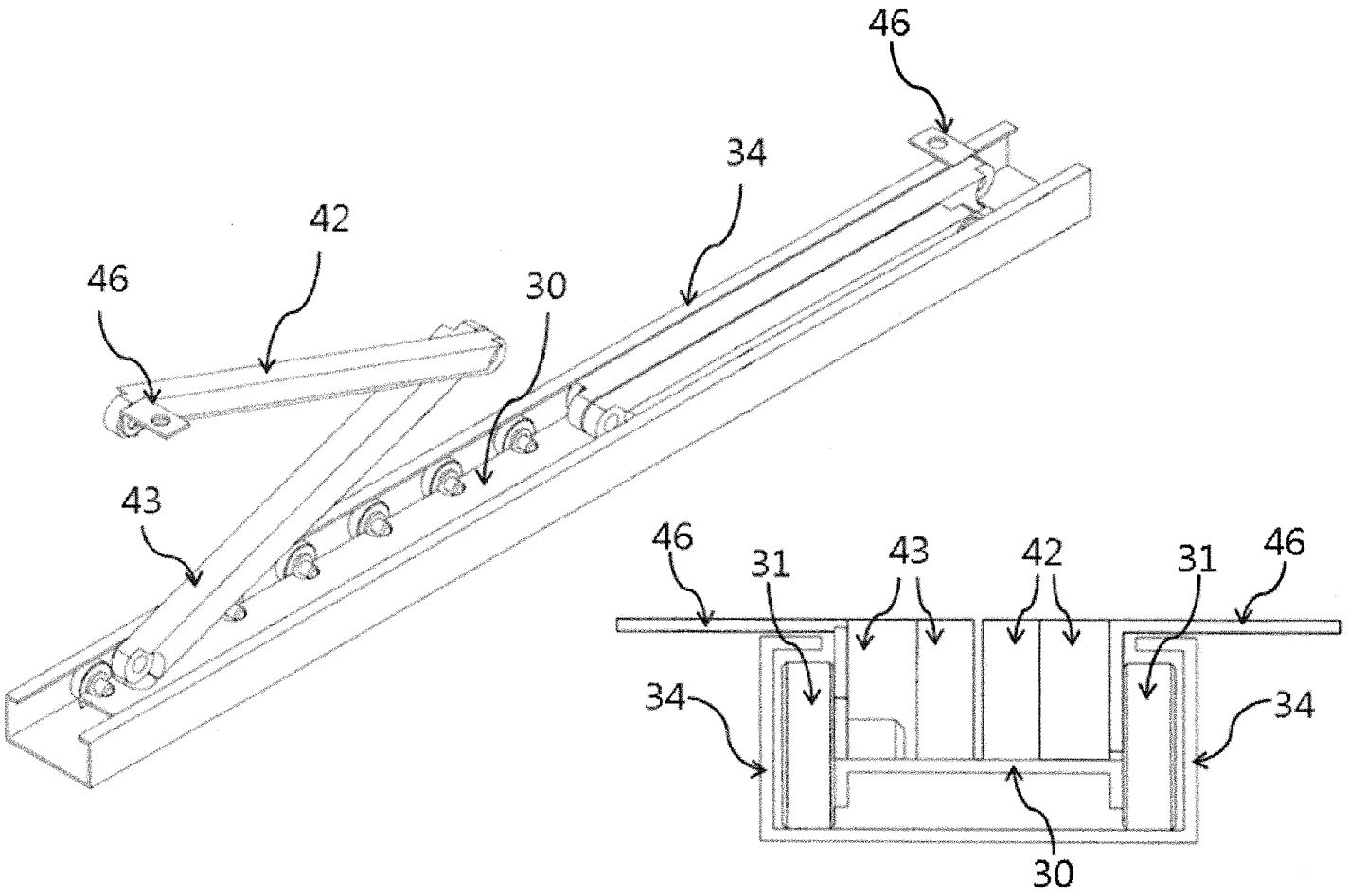
FIG. 9 is a configuration view of the transfer arm without transfer arm housing rollers.
Figure 10:
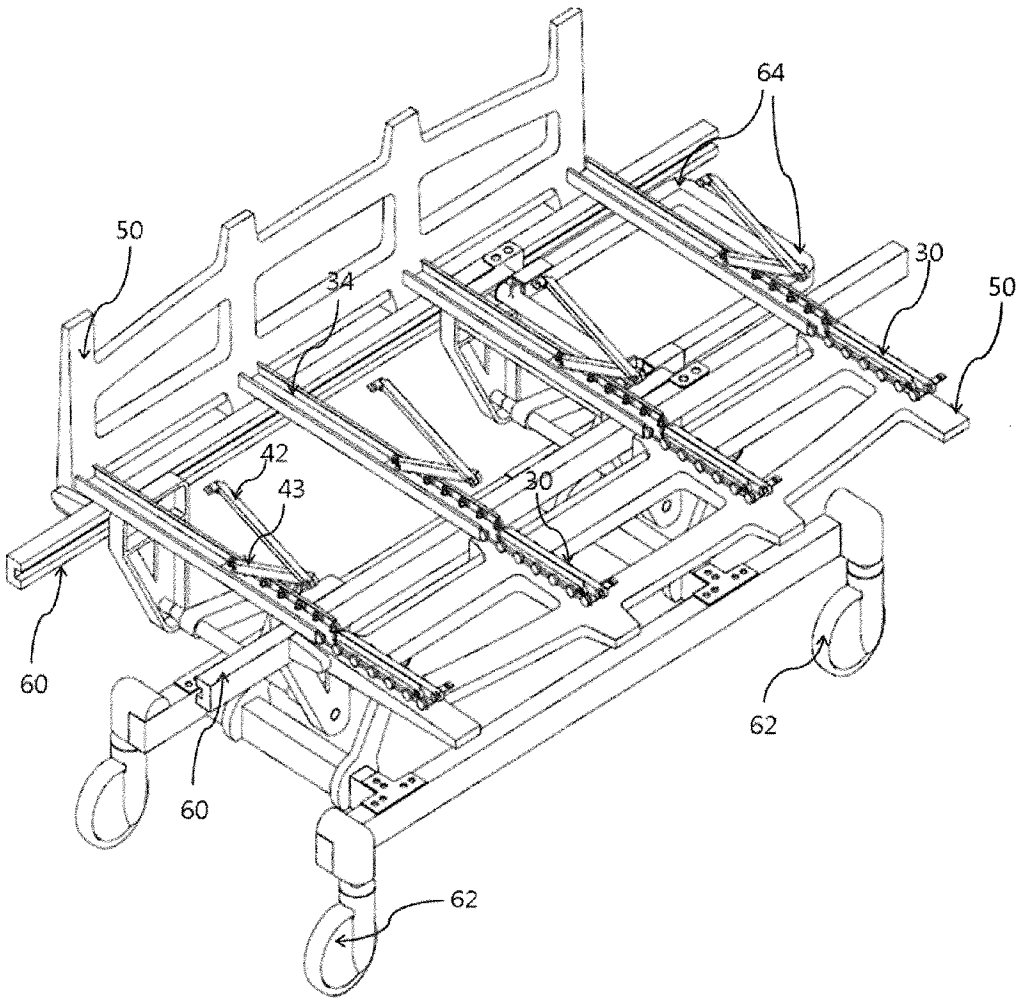
FIG. 10 is a view illustrating the transfer arms moving over a side protector.

FIG. 8 shows a structure of the transfer arm (30) and the transfer arm housing (34) with no linkages. In a case where the linkages do not present, the transfer arm (30) is directly connected with the top movable board (10), and thus the top movable board cannot be inclined. FIG. 9 shows a simple structure of the transfer arm and the transfer arm housing with no transfer arm housing rollers (35). A slight gap is present between each transfer arm roller (31) and the transfer arm housing (34) of FIG. 9, and therefore the transfer arm may be slightly inclined to thereby cause a part of the transfer arm roller (31) to contact with the transfer arm housing when the top movable board (10) is moved. At this time, the transfer arm roller (31) contacting with the transfer arm housing (34) performs a role of the transfer arm housing rollers (35), whereby the structure of the transfer arm and the transfer arm housing becomes simple. Furthermore, FIG. 10 shows a state of the transfer arm (30) and the transfer arm housing (34) when the transfer arm (30) is moved over the side protector (50) and then the top movable board (10) is erected.

Figure 11:
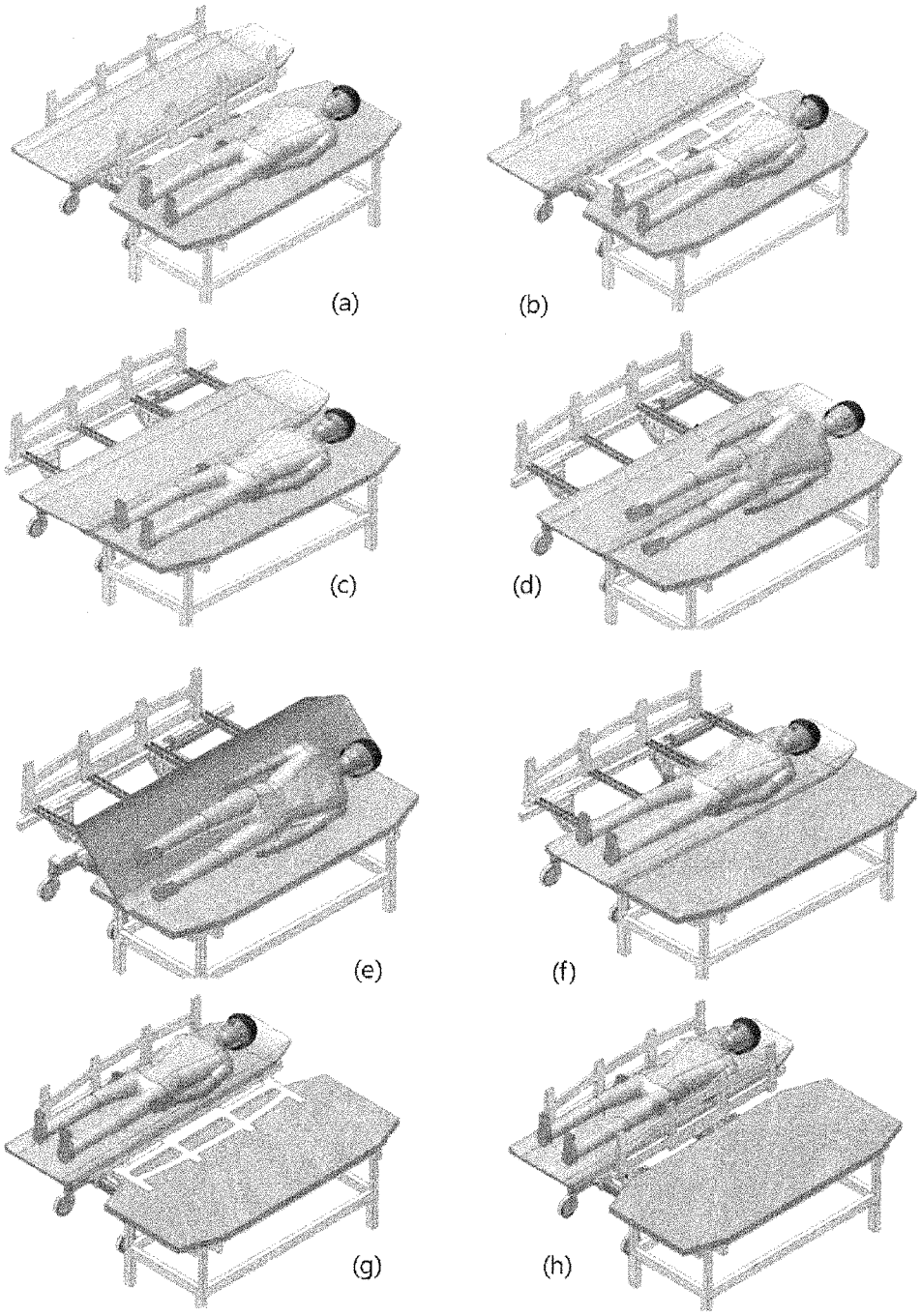
FIG. 11 is a view illustrating a step of loading a patient onto the patient-moving bed.
Figure 12:
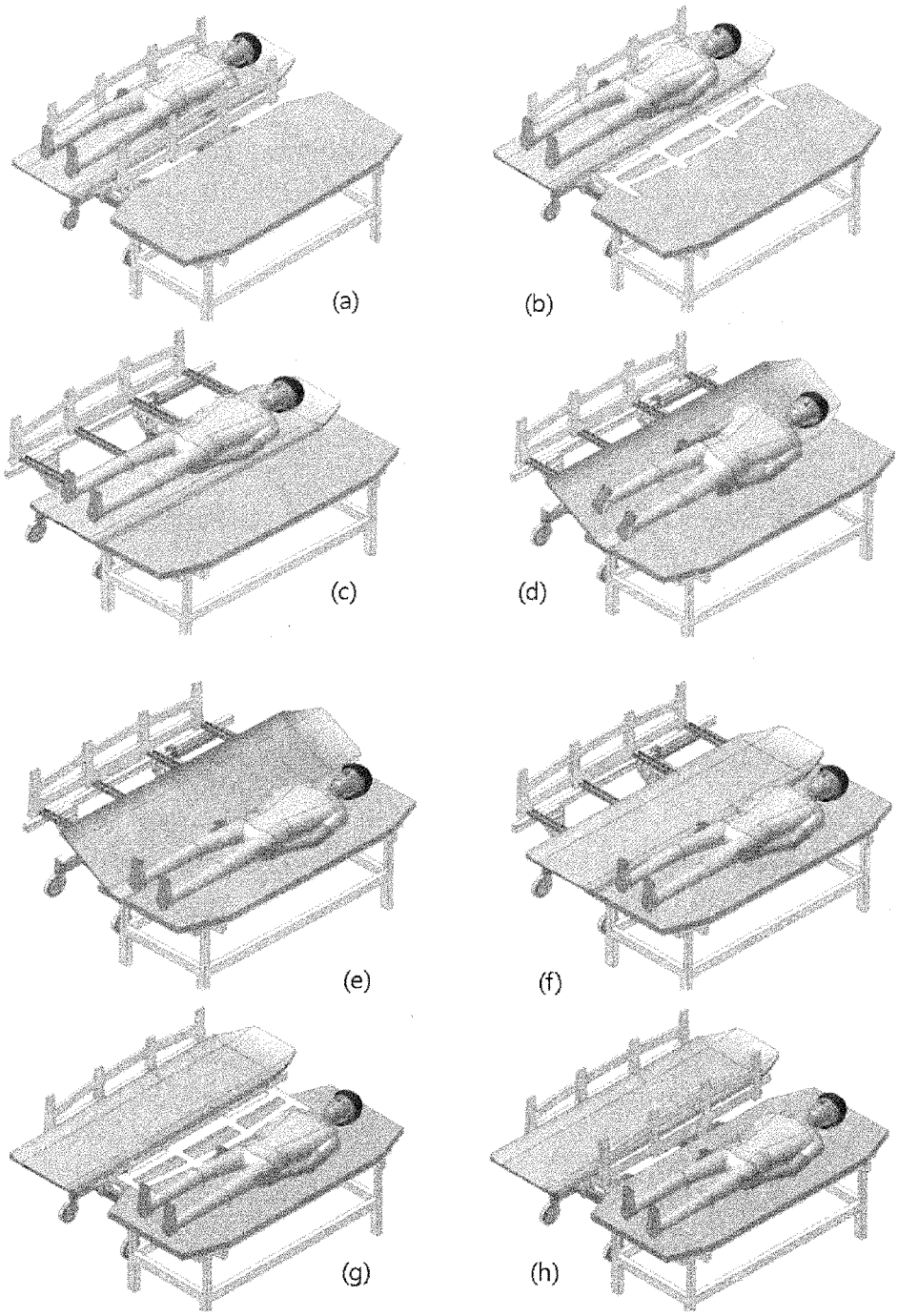
FIG. 12 is a view illustrating a step of unloading the patient from the patient-moving bed.

Steps of loading and unloading the patient onto and from the patient-moving bed are shown in FIGS. 11 and 12. First, in order to load the patient onto the patient-moving bed from the patient bed, the patient-moving bed is brought alongside the patient bed as shown in FIG. 11(*a*), and then the side protector (50) of the patient-moving bed is first laid on the patient bed (70) as shown in FIG. 11(*b*). As shown in FIG. 11(*c*), the top movable board (10) can be easily moved over the transfer arm housing (34) and the side protector (50) through the transfer arms. When the patient erects his/her back in order to be loaded onto the patient-moving bed as shown in FIG. 11(*d*), the top movable board is moved toward the patient to be positioned close to the patient and then erected, and then the patient leans the back against the top movable board, as shown in FIG. 11(*e*). At this time, when the top movable board is laid down as shown in FIG. 11(*f*), the patient's body is naturally laid on the top movable board (10), and when the top movable board (10) is pushed toward the patient-moving bed, the transfer arms connected to the top movable board (10) are moved over the side protector (50) as shown in FIG. 11(*f*). At this time, a great force is not required for moving the top movable board (10) since the top movable board (10) is moved over the transfer arm housings (34) and the side protector (50) through the transfer arm wheels (31). When the patient's body is completely transferred to the patient-moving bed as shown in FIG. 11(*g*), the side protector is erected as shown in FIG. 11(*h*).

In addition, once the patient's body is completely loaded on the patient-moving bed, movement of the top movable board (10) has to be prevented by erecting the side protectors (50) on both sides of the patient-moving bed before the patient-moving bed is moved. The side protector (50) serve to protect the patient's body from falling off the patient-moving bed during the movement of the patient and also to prevent the movement of the top movable board (10) and the transfer arms (30).

When the patient is to be unloaded from the patient-moving bed onto the patient bed, the patient-moving bed is brought alongside the patient bed as shown in FIG. 12(*a*), and then the side protector (50) of the patient-moving bed is first laid on the patient bed as shown in FIG. 12(*b*). When the top movable board (10) loaded with the patient's body is pushed toward the patient bed as shown in FIG. 12(*c*), the top movable board (10) is moved toward the patient bed over the transfer arm housings (34) and the side protector (50) through the transfer arms. When the top movable board (10) connected with the linkages (42,43) is inclined toward the patient bed as shown in FIG. 12(*d*), the patient's body naturally slides down toward the patient bed as shown in FIG. 12(*e*) while the center of gravity of the patient is shifted. After the patient's body has slid down to the patient bed, the top movable board (10) is pushed again toward the patient-moving bed as shown in FIGS. 12(*f*) and 12(*g*) and thus easily withdrawn.

In the present invention, the top movable board (10) and the transfer arms (30) are movable in both left and right directions of the patient-moving bed, whereby a great convenience is provided.

In moving the patient from the patient bed to the patient-moving bed or in moving the patient from the patient-moving bed to the patient bed, stability of the patient-moving bed is very important. In particular, it is very important to prevent the patient-moving bed from falling down since the center of gravity of the patient's body is shifted. After the patient-moving bed has been brought alongside the patient bed in order to transfer and loaded or unload the patient onto or from the patient-moving bed, it is important to first lock wheels (62) (FIG. 10) of the patient-moving bed through a wheel-locking device. In the present invention, the side protectors (50) serve as a safety device for preventing the patient-moving bed from falling down during transfer of the patient lying on the patent bed.

A very significant advantage of the present invention lies in that a step is not required of separately installing or withdrawing auxiliary device such as the transfer arms (30) etc. and the patient can be easily loaded onto the patient-moving bed without much effort by simply pushing the top movable board (10) from the patient-moving bed toward the patient to thereby load the patient on the top movable board (10) and then pushing the top movable board (10) again toward the patient-moving bed. In addition, also in a case of unloading the patient from the patient-moving bed to the patient bed, the patient can be easily unloaded from the patient-moving bed onto the patient bed without much effort by simply pushing the top movable board (10) toward the patient bed to thereby unload the patient and then pushing the top movable board again toward the patient-moving bed as shown in FIG. 12, without a step of separately installing or withdrawing the auxiliary device.

Figure 13:
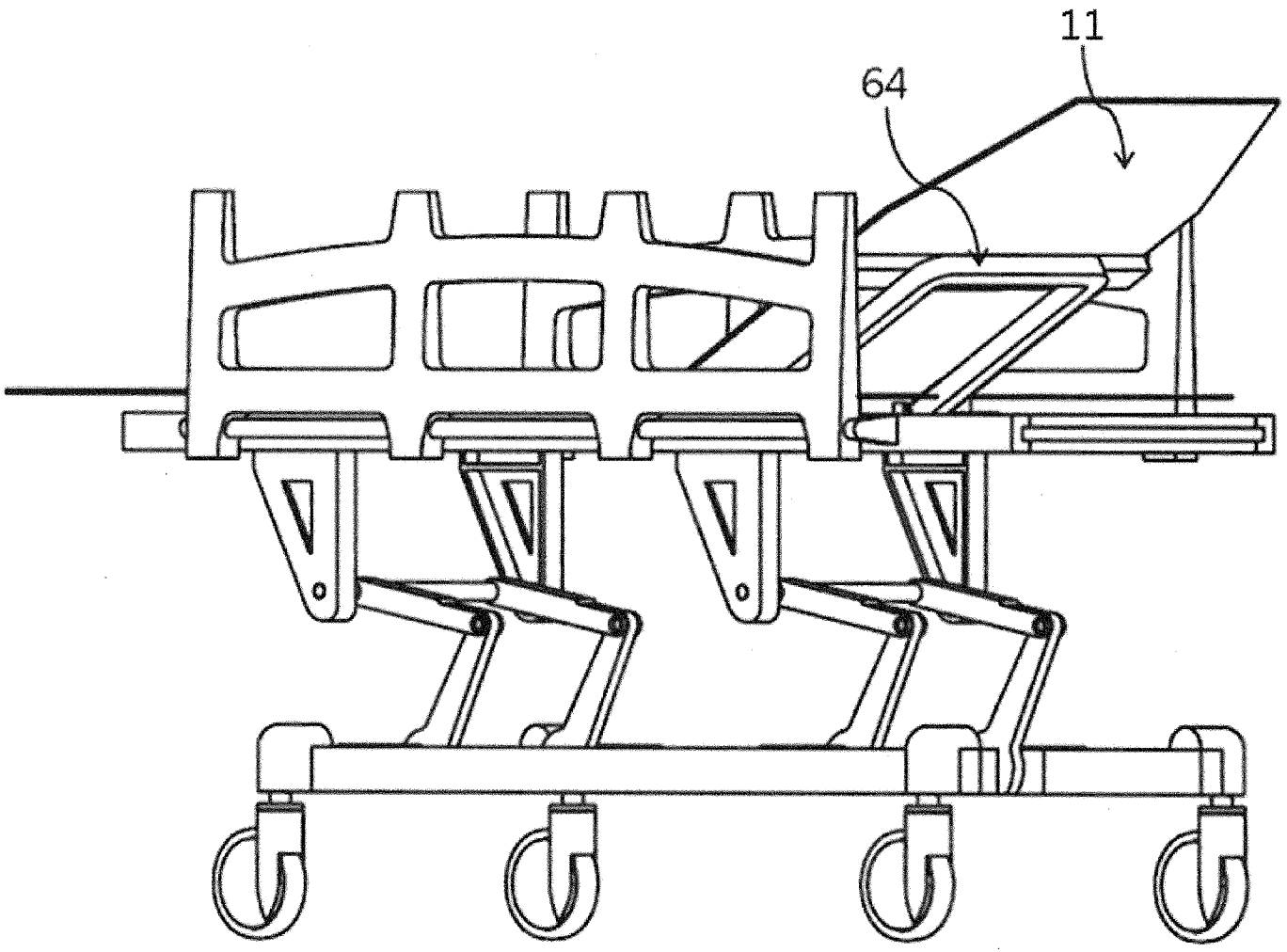
FIG. 13 is a view illustrating a state where a movable part of a top movable board is raised up.

As shown in FIG. 10, the transfer arm housings (34) are fixed to a patient-moving bed frame (60). The patient-moving bed frame (60) with the transfer arm housings (34) installed thereon may raise a movable part (11) of the top movable board through a movable support (64) (FIGS. 10 and 13) for the top movable board as necessary. In a case where the patient has to wait on the patient-moving bed for a long time, the movable part (11) of the top movable board may be raised up to thereby allow the patient to more comfortably lie, as shown in FIG. 13.

INDUSTRIAL APPLICABILITY

There are many cases where the patient has to be transferred from the patient bed (70) onto the patient-moving bed for moving the patient from a sickroom to examination and inspection rooms. Furthermore, there are also many cases where the patient has to be transferred from the patient-moving bed onto various inspection apparatuses such as x-ray machine, MRI scanner etc. On all such occasions, it is not easy to move the patient having problems with mobility. On all occasions of moving the patient, a lot of pains are caused to the patient and several persons have to be mobilized. Particularly, as obesity of people recently becomes severe, very great inconvenience occurs in moving the patient having a great weight.

The present invention may be used for an apparatus which can easily move the patient having problems with mobility while causing minimum inconvenience to the patient when the patient is transferred between the patient bed and the patient-moving bed.

What is claimed is:

1. A patient transfer apparatus comprising:

a top movable board on which a patient's body can be loaded;

transfer arms which are connected to the top movable board and are configured to allow the top movable board to be easily moved;

transfer arm housings which are fixed to a frame of a patient-moving bed and are configured such that the transfer arms can move using the transfer arm housings; and side protectors which are provided at a side of the frame of the patient-moving bed and are configured to, when laid on a patient bed, provide a guide rail to which the transfer arms are guided to slide along such that the transfer arms are easily moved along the side protectors over the patient bed.

2. The patient transfer apparatus according to claim 1, wherein linkages are installed between the top movable board and each transfer arm, and wherein the linkages provide a pivot that allows the top movable board to be easily inclined when the patient's body is loaded or unloaded.

3. The patient transfer apparatus according to claim 2, wherein a length of an upper linkage is different from that of a lower linkage so that a position of the pivot provided by the linkages can be effectively adjusted when the top movable board is inclined.

4. The patient transfer apparatus according to claim 1, wherein a movable part of the top movable board is installed so that at least a part of the top movable board is raised up.

* * * * *